US005305503A

United States Patent [19]

Yamagata

[11] Patent Number: 5,305,503

[45] Date of Patent: Apr. 26, 1994

[54] BUCKLE FOR WATCH BANDS

[75] Inventor: Hisao Yamagata, Higashimurayama, Japan

[73] Assignee: Citizen Watch Co., Ltd., Tokyo, Japan

[21] Appl. No.: 109,057

[22] Filed: Aug. 19, 1993

[51] Int. Cl.[5] ..... A44C 5/00

[52] U.S. Cl. ..... 24/68 J; 24/71 J; 24/265 WS

[58] Field of Search ..... 24/68 J, 70 J, 71 J, 24/265 WS, 69 J, 653, 656

[56] References Cited

U.S. PATENT DOCUMENTS

| | | | |
|---|---|---|---|
| 4,330,905 | 5/1982 | Wolfgang | 24/71 J |
| 4,382,318 | 5/1983 | Takimoto | 24/265 WS |
| 4,675,955 | 6/1987 | Nakamura | 24/265 WS |
| 5,191,685 | 3/1993 | Aoki et al. | 24/68 J |

FOREIGN PATENT DOCUMENTS 3-101211 10/1991 Japan .

*Primary Examiner*—Victor N. Sakran

*Attorney, Agent, or Firm*—John T. Roberts

[57] ABSTRACT

A buckle has a cover rotatably connected to an end of one of bands, a middle plate rotatably connected to the cover, and a bottom plate rotatably connected to the middle plate and rotatably connected to the other band. A guide housing is secured to an underside of the cover, and a pair of push plates are slidably mounted in the guide housing. A spring is provided between the push plates for outwardly urging the push plates respectively. A slant is formed on an engaging projection of the push plate. A pair of lugs are formed on the bottom plate. Each of the lugs has an engaging hole and is arranged such that the lug is engaged with the slant so as to inwardly move the push plate, and that the engaging hole engages with engaging projection of the push plate, thereby coupling the buckle. A leaf spring is provided for urging the cover in a disengaging direction.

5 Claims, 5 Drawing Sheets

BUCKLE FOR WATCH BANDS

BACKGROUND OF THE INVENTION

The present invention relates to a triple-fold type buckle for watch bands.

Japanese Utility Model Application Laid-open No. 3-101211 discloses a triple-fold type buckle. The buckle comprises a cover connected to one of the watch bands, a middle plate connected to the cover by a lateral pin, and a bottom plate connected to the middle plate by a lateral pin and to the other band. A casing having a pair of push plates is secured to the underside of the cover. The push plates are slidably mounted in the casing and a spring is provided between the push plates so as to urge the push plates outwardly. Each push plate has a manipulating portion projected from the cover through the casing, and a hook portion formed on an inner portion thereof so as to be projected from the casing. The middle plate has a pair of holes formed, corresponding to the hook portions of the push plates. The bottom plate has a pair of engaging projections to be engaged with the hook portions.

In order to couple the buckle, the cover and the middle plate are folded on the bottom plate so that the hook portions of the push plates are engaged with the engaging projections of the bottom plate through the holes of the middle plate. Thus, the cover is locked to the bottom plate. When disengaging the buckle, the manipulating portions of the push plates are pushed against the elastic force of the spring so that the hook portions are disengaged from the engaging projections.

However, when pushing the push plates in order to disengage the buckle, the user can not know whether the hook portions are entirely disengaged from the engaging projections. Accordingly, if the fingers pushing the push plates are released from the manipulating portions despite incomplete disengagement, the hook portions may be re-engaged with the engaging projections. Therefore, the cover must be forcibly opened by a finger under the condition that the push plates are pressed by other fingers.

Since the hook portions are projected from the underside of the cover to be engaged with engaging projections of the bottom plate and abutted on the middle plate when coupling, the thickness of the buckle is large.

Furthermore, since the holes must be formed on the middle plate, manufacturing process of the parts is complicated.

SUMMARY OF THE INVENTION

An object of the present invention is to provide a triple-fold type buckle in which the disengagement of the buckle is ensured.

Another object of the present invention is to provide a buckle which is reduced in thickness and size and may be easily manufactured.

According to the present invention, there is provided a buckle for watch bands having a first band and a second band, the buckle including a cover having opposite side plates, each of which has an opening, and rotatably connected to an end of the first band at one of longitudinal ends thereof, a middle plate rotatably connected to the other end of the cover at one of longitudinal ends thereof, a bottom plate rotatably connected to the other end of the middle plate at one of longitudinal ends thereof and rotatably connected to an end of the second band at the other end thereof.

The buckle comprises a guide housing secured to an underside of the cover, a pair of push plates slidably mounted in the guide housing so as to slide in the lateral direction with respect to the longitudinal direction of the bands, a spring provided between the push plates for outwardly urging the push plates respectively, stopping means for stopping each of push plates at a position where an outer end portion of the push plates is projected from the opening of the plate of the cover so as to be operated by a finger of a wearer, a slant formed at a part of each push plate, which is inclined toward the underside of the cover, a pair of lugs formed on the bottom plate to be projected to the cover, each of the lugs having an engaging portion and being arranged such that a part of the lug is engaged with the slant so as to inwardly move the push plate due to the inclination of the slant when the bottom plate is pivoted toward the cover, and that the engaging portion engages with the push plate at an opposite surface of the slant when the engaging portion passes the slant, and resilient means provided for urging the cover in a disengaging direction.

These and other objects and features of the present invention will become more apparent from the following detailed description with reference to the accompanying drawings.

DETAILED DESCRIPTION OF THE PREFERRED EMBODIMENT

Figure 1:
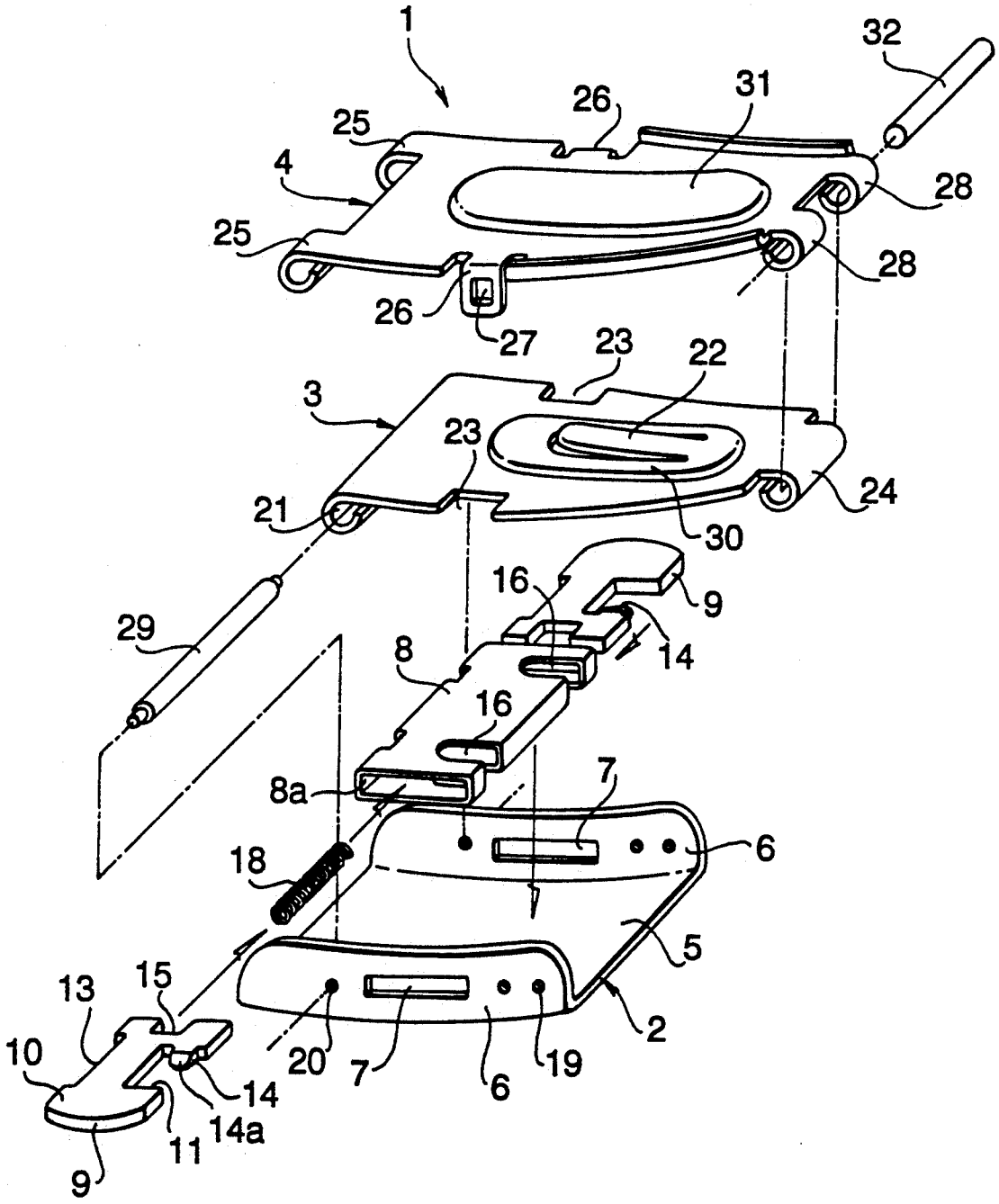
FIG. 1 is an exploded perspective view showing a triple-fold type buckle according to the present invention.

Referring to FIGS. 1 to 4, a triple-fold type buckle 1 of the present invention comprises a cover 2 connected to a watch band 34 (FIG. 6), a bottom plate 4 connected to another watch band 35, and a middle plate 3 connected to the cover 2 and the bottom plate 4. The bottom plate 4 is formed to be curved so as to fit a wrist of a wearer, and the middle plate 3 and the cover 2 are curved accordingly.

The cover 2 comprises a top plate 5 and a pair of side plates 6. Each side plate 6 has a series of adjusting holes 19 to adjust the effective length of the watch band 34, a pin hole 20 for connecting the middle plate 3 by a pin 29, and a rectangular opening 7 formed in a central portion thereof.

A hollow guide housing 8 is disposed inside the cover 2 in the lateral direction of the band and secured to the underside of the top plate 5. The guide housing 8 has a pair of openings 8*a* at opposite ends thereof corresponding to the opening 7 of the side plates 6, a pair of notches 16 formed in one of the sides thereof to be penetrated through upper and lower plates of the housing, and a pair of stoppers 17 (FIG. 2) formed on the other side by cutting.

Figure 2:
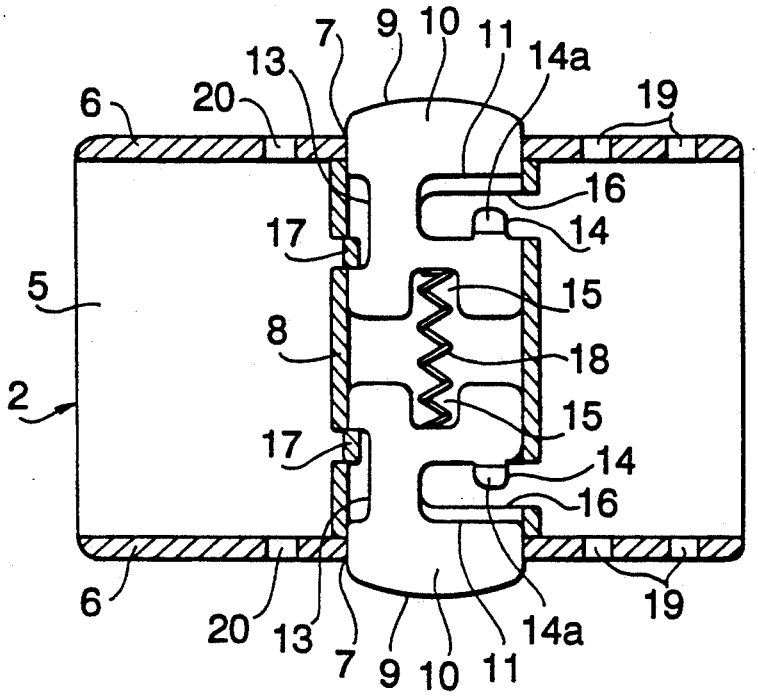
FIG. 2 is a sectional plan view of a cover of the buckle.
Figure 3:
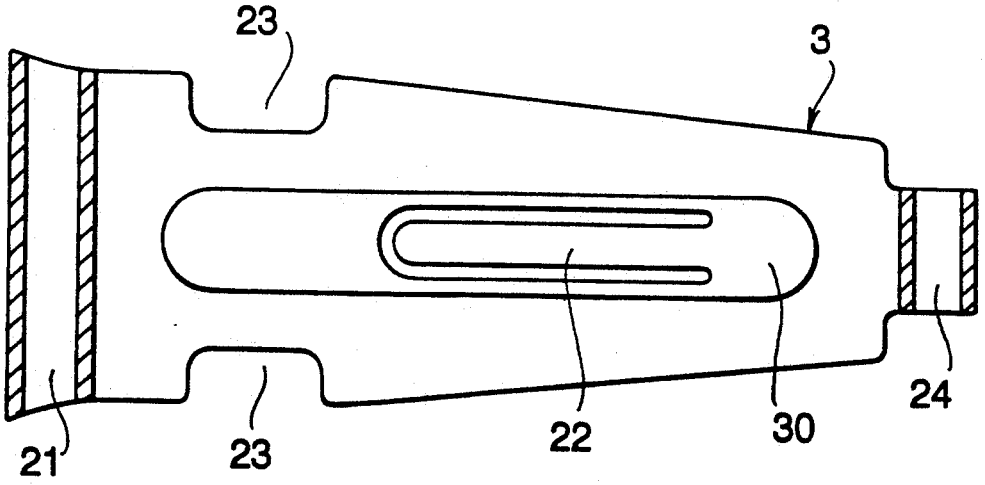
FIG. 3 is a sectional plan view of a middle plate.
Figure 4:
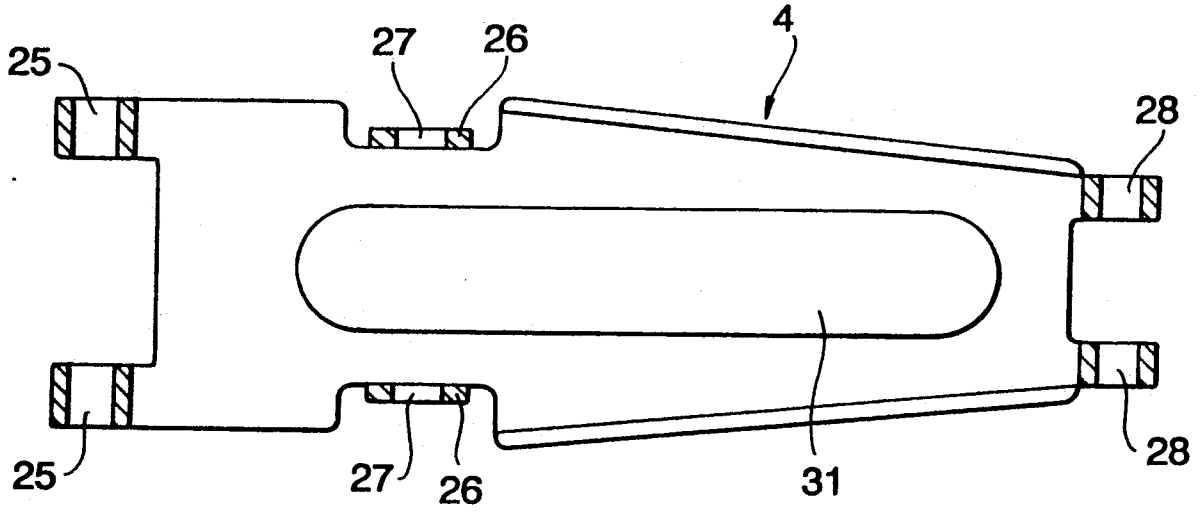
FIG. 4 is a sectional plan view of a bottom plate.

A pair of push plates 9 are slidably mounted in the space of the housing 8 so as to be moved in the lateral direction of the band. As shown in FIG. 2, the push plates 9 are the same in configuration and are symmetrically disposed in the housing 8. Each push plate 9 comprises a manipulating lug 10 projected from the opening 7 of the side plate 6 through the opening 8*a*, a notch 11 formed on one of the sides thereof corresponding to the notch 16 of the housing 8, an engaging projection 14 laterally projected from an inside wall of the notch 11 and having a slant 14*a* inclined toward the underside of the cover 2, a notch 13 formed on the other side opposite to the notch 11 to be engaged with the stopper 17 of the housing, and a notch 15 formed opposite to the manipulating lug 10.

To assemble the cover 2, a return spring 18 is disposed between the notches 15 of the opposite push plates 9, and the unit of the push plates is inserted into the housing 8 from one of the openings 7. Thereafter, each stopper 17 is bent toward the notch 13. Since the stoppers 17 are engaged with inside walls of the notches 13, the push plates 9 are prevented from removing from the housing 8. In this state, the notch 11 is disposed corresponding to the notch 16 so that the engaging projection 14 is exposed in the notch 16.

The middle plate 3 comprises a rounded portion 21 provided at the end thereof, and a rounded portion 24 provided at the other end to be engaged with the pin 29. A recess 30 is formed in a central portion of the middle plate, projected toward the bottom plate 4 for reinforcing the plate. The reinforcing recess 30 is cut at a central portion to form a cantilevered leaf spring 22 which is to be pressed against the bottom plate 4 as described hereinafter. The middle plate 3 is further provided with a pair of notches 23 formed on both sides corresponding to the notches 16 of the housing 8.

The bottom plate 4 has a pair of rounded portion 25 provided at one of ends, and a pair of rounded portions 28 provided at the other end to be engaged with a pin 32. A recess 31 is formed in a central portion by press corresponding to the recess 30 for reinforcing the plate. The reinforcing recess 31 is larger than the recess 30. A pair of lugs 26 each having an engaging hole 27 are formed on both the sides of the bottom plate by bending each side toward the cover, corresponding to the notches 23 of the middle plate 3.

In order to assemble the buckle 1, the cover 2 is connected to the watch band 34 by a spring-loaded pin 19*a* at a selected adjusting hole 19. The pin 29 is inserted into the rounded portion 21 of the middle plate 3 and engaged with each hole 20 of the cover 2 so that the middle plate 3 is rotatably connected to the cover 2. The rounded portions 28 of the bottom plate 4 is connected with the rounded portion 24 of the middle plate 3 by the pin 32 so that the middle plate 3 is rotatably connected to the bottom plate 4. The band 35 is connected to the rounded portions 25 by a spring-loaded pin 25*a*.

Describing the use of the buckle 1, the bottom plate 4 and the middle plate 3 are stretched to expand the buckle, and the bands 34 and 35 are applied to a wrist of the wearer.

Figure 5:
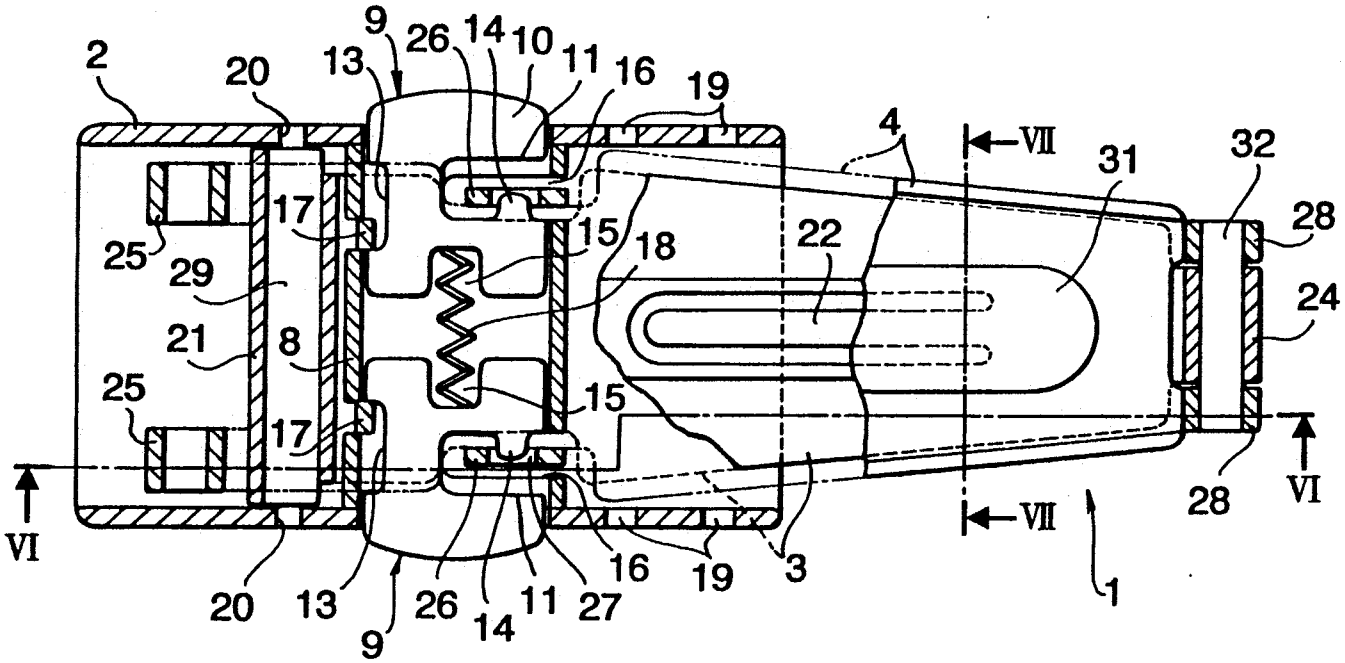
FIG. 5 is a sectional plan view of the buckle.
Figure 6:
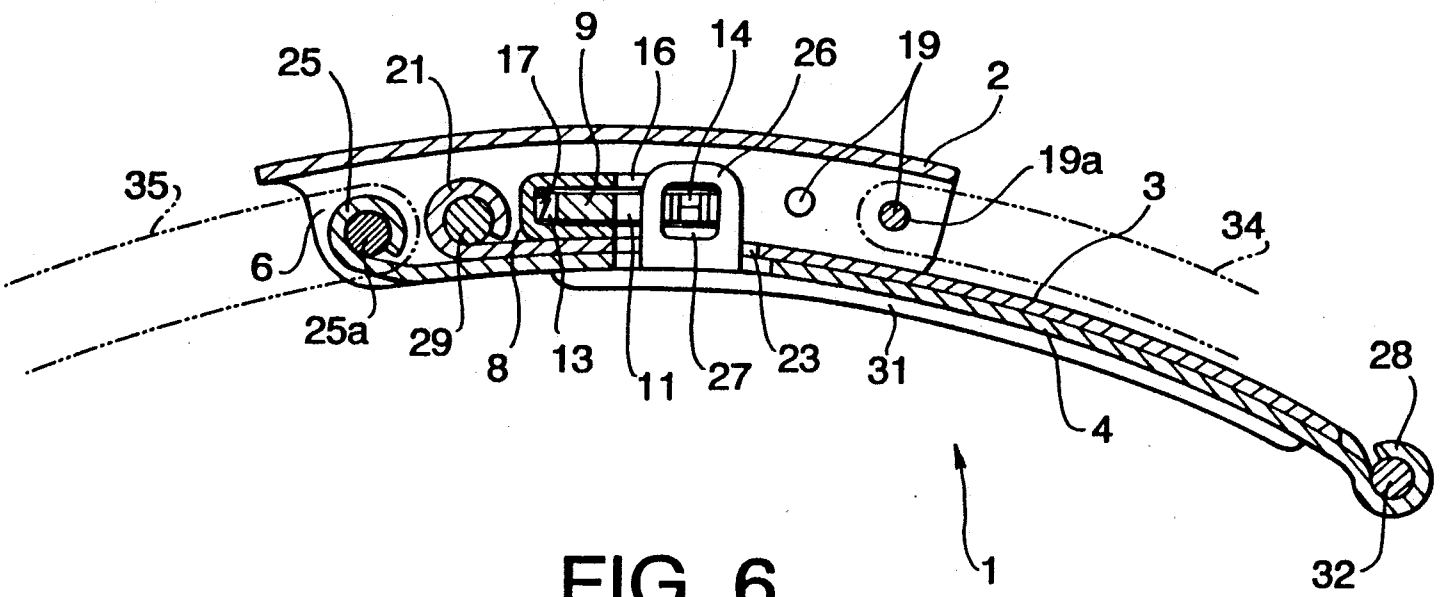
FIG. 6 is a sectional side view of the buckle taken along a line VI—VI of FIG. 5.
Figure 7:
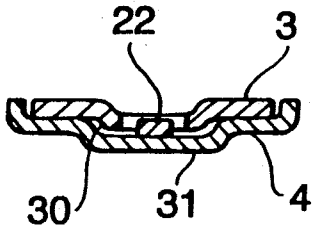
FIG. 7 is a sectional view of the buckle taken along a line VII—VII of FIG. 5.

The cover 2 and the middle plate 3 are folded on the bottom plate 4. The cover 2 is pushed to the middle plate 3 so that the middle plate is pressed against the bottom plate 4. The engaging lugs 26 of the bottom plate 4 are inserted in the notches 23 of the middle plate 3 and inserted into the notches 11 of the push plates 9 in the housing 8 through the notches 16 of the housing. The engaging lugs 26 are engaged with the engaging projections 14 of the respective push plates 9 at the slant 14*a* to inwardly push the projections 14 against the elastic force of the spring 18. When the engaging lugs 26 pass the slant 14*a*, the engaging projections 14 are returned by the spring 18 and engaged with the holes 27 of the lugs 26. Thus, the cover 2 is locked to the bottom plate 4 as shown in FIGS. 5 and 6. In this state, the leaf spring 22 of the middle plate 3 is abutted on the corresponding wall of the reinforcing recess 31 of the bottom plate 4 as shown in FIG. 7, so that the cover 2 is urged in the upward direction.

In order to disengage the buckle 1, the manipulating lugs 10 of the push plates 9 are pushed at the same time so that the engaging projections 14 are disengaged from the holes 27 of the engaging lugs 26. Thus, the bottom plate 4 is released from the cover 2. Since the leaf spring 22 of the middle plate 3 is abutted on the bottom plate 4 so as to urge the cover 2 in the upward direction, the cover 2 is automatically opened.

In accordance with the present invention, a leaf spring is provided on the middle plate to be abutted on the bottom plate so as to urge the cover in the upward direction. When the bottom plate is disengaged from the cover, the cover is automatically pushed up. Since it is not necessary to forcibly push up the cover by fingers under the condition that the manipulating lugs pressed, the buckle is easily disengaged. The parts of the buckle are easily manufactured without boring working. Furthermore, the buckle is reduced in thickness and size, thereby providing a good appearance.

While the invention has been described in conjunction with preferred specific embodiment thereof, it will be understood that this description is intended to illustrate and not limit the scope of the invention, which is defined by the following claims.

What is claimed is:

1. A buckle for watch bands having a first band and a second band, the buckle including a cover having opposite side plates, each of which has an opening, and rotatably connected to an end of said first band at one of longitudinal ends thereof, a middle plate rotatably connected to the other end of said cover at one of longitudinal ends thereof, a bottom plate rotatably connected to the other end of said middle plate at one of longitudinal ends thereof and rotatably connected to an end of said second band at the other end thereof, the buckle comprising a guide housing secured to an underside of said cover;

a pair of push plates slidably mounted in said guide housing so as to slide in the lateral direction with respect to the longitudinal direction of the bands;

a spring provided between the push plates for outwardly urging the push plates respectively;

stopping means for stopping each of push plates at a position where an outer end portion of the push plates is projected from the opening of said plate of the cover so as to be operated by a finger of a wearer;

a slant formed at a part of each push plate, which is inclined toward the underside of the cover;

a pair of lugs formed on said bottom plate to be projected to the cover, each of the lugs having an engaging portion and being arranged such that a part of the lug is engaged with said slant so as to inwardly move the push plate due to the inclination of the slant when the bottom plate is pivoted toward the cover, and that the engaging portion engages with the push plate at an opposite surface of said slant when the engaging portion passes the slant; and resilient means provided for urging the cover in a disengaging direction.

2. The buckle according to claim 1, wherein said stopping means comprises a stopper formed on the guide housing and a notch formed on the push plate so as to be engaged with the stopper.

3. The buckle according to claim 1, wherein said slant is formed on an engaging projection formed on the push plate which is provided to be engaged with the engaging portion of the lug.

4. The buckle according to claim 1, wherein said engaging portion of the lug is an engaging hole formed in the lug.

5. The buckle according to claim 1, wherein said resilient means is a leaf spring provided on the middle plate to be pressed against the bottom plate.

* * * * *

UNITED STATES PATENT AND TRADEMARK OFFICE

CERTIFICATE OF CORRECTION

PATENT NO. : 5,305,503

DATED : April 26, 1994

INVENTOR(S) : Hisao Yamagata

It is certified that error appears in the above-indentified patent and that said Letters Patent is hereby corrected as shown below:

On the title page: Item [30] Foreign Application Data should read -- August 24, 1992 [JP] 4-64436 [U] --.

Signed and Sealed this

Eighth Day of November, 1994

*Attest:*

Bruce Lehman

BRUCE LEHMAN

*Attesting Officer*

*Commissioner of Patents and Trademarks*